US005375520A

United States Patent [19]

Köbler et al.

[11] Patent Number: 5,375,520

[45] Date of Patent: Dec. 27, 1994

[54] DEVICE FOR FASTENING A FLEXIBLE PRINTING PLATE

[75] Inventors: Ingo Köbler, Anhausen; Klaus T. Reichel, Augsburg, both of Germany

[73] Assignee: MAN Roland Druckmaschinen AG., Offenbach am Main, Germany

[21] Appl. No.: 101,465

[22] Filed: Aug. 2, 1993

[30] Foreign Application Priority Data

Aug. 6, 1992 [DE] Germany ..... 4225949

[51] Int. Cl.[5] ..... B41F 1/28

[52] U.S. Cl. ..... 101/415.1; 101/378; 101/383

[58] Field of Search ..... 101/378, 382.1, 383, 101/384, 395, 409, 415.1, 385

[56] References Cited

U.S. PATENT DOCUMENTS

| | | | |
|---|---|---|---|
| 3,387,559 | 6/1968 | Horner | 101/378 |
| 3,757,691 | 9/1973 | Etchell et al. | 101/378 |
| 4,191,106 | 3/1980 | Fermi et al. | 101/378 |
| 4,214,530 | 7/1980 | Signorelli et al. | 101/415.1 |
| 4,223,604 | 9/1980 | Brehar et al. | 101/383 |
| 4,659,446 | 4/1987 | Shafer et al. | 204/212 |
| 5,213,038 | 5/1993 | Takahashi et al. | 101/415.1 |

FOREIGN PATENT DOCUMENTS

| | | |
|---|---|---|
| 0039765 | 3/1981 | European Pat. Off. . |
| 4035664A1 | 6/1991 | Germany . |
| 910712 | 8/1959 | United Kingdom . |

*Primary Examiner*—Edgar S. Burr
*Assistant Examiner*—Lynn D. Hendrickson
*Attorney, Agent, or Firm*—Cohen, Pontani, Lieberman, Pavane

[57] ABSTRACT

A device for fastening a flexible printing plate (11) on a form cylinder includes a plurality of leaf-shaped springs (5) disposed in a slot (2) of the form cylinder (1). The springs (5) have two legs (6, 7) which rest in the slot (2), one leg (6) being elongated and tensioning the edges (12, 13) of the printing plate (11).

5 Claims, 1 Drawing Sheet

DEVICE FOR FASTENING A FLEXIBLE PRINTING PLATE

FIELD OF THE INVENTION

The present invention is directed to a device for fastening a flexible printing plate on the form cylinder of a printing machine with at least one slot having parallel lateral surfaces and extending in the axial direction.

BACKGROUND AND SUMMARY OF THE INVENTION

U.S. Pat. No. 4,304,182 shows a plate tensioning means in which the folds or edges of the printing plate are inserted into a slot extending in the axial direction of the form cylinder. The edges are bent down and are elastically pretensioned between the lateral surfaces of the slot or between one lateral surface and the second printing plate edge contacting the other lateral surface. The tensioning force serves to secure the plate edges against slipping out by frictional engagement. However, aluminum printing plates or copper printing plates do not possess a sufficient modulus of elasticity for applying the spring forces required for reliably securing the plate.

U.S. Pat. No. 1,949,132 likewise shows a plate tensioning means in which the plate edges are inserted into a slot extending in the longitudinal direction of the form cylinder. In this instance, a ridge or strip is located in the tensioning slot, the strip being supported by flexible tongues against the side wall of the tensioning slot in order to secure the first edge of the printing plate pressed into the tensioning slot during the ongoing tensioning process. This tensioning device is not suitable for automatic plate insertion.

One object of the present invention is to provide a plate tensioning device which tensions the printing plate in a reliable manner using simple means and which is suitable for automatic plate changing.

This object is met in a device for fastening a flexible printing plate on the form cylinder of a printing machine, this form cylinder including at least one slot having a base and parallel lateral surfaces and extending in the axial direction, comprising a plurality of leaf-shaped springs disposed in the slot so as to be distributed along its length, each spring having two legs which are pretensioned when inserted into the slot base and contact the lateral surfaces of the slot in a U-shaped manner, one leg being elongated, containing a depression and having a rounded end portion; and the edges of the printing plate being received between the elongated leg and the adjacent lateral surfaces. The slot of the form cylinder and the leaf-shaped springs located therein are simple to produce in an inexpensive manner. The slot can be constructed so as to be very narrow due to the slender design of the springs, so that the loss of printing surface caused by the slot can be kept very low. The spring, which can be produced from steel, applies the required spring force for its secure fit in the cylinder slot in the installed state, there being no special requirements for surface roughness. Further, the elongated leg supplies the necessary, proportioned tensioning force for reliably tensioning the printing plate edges, enabling the following edges to be tensioned subsequently. Also, the printing form protects the spring and the slot from dirt and aggressive media in that it covers them. Finally, the device enables an automatic exchange of plates, e.g. by means of a robot.

BRIEF DESCRIPTION OF THE DRAWINGS

The invention is explained in more detail below with reference to the drawings in which.

DETAILED DESCRIPTION OF THE PRESENTLY PREFERRED EMBODIMENTS

Figure 1:
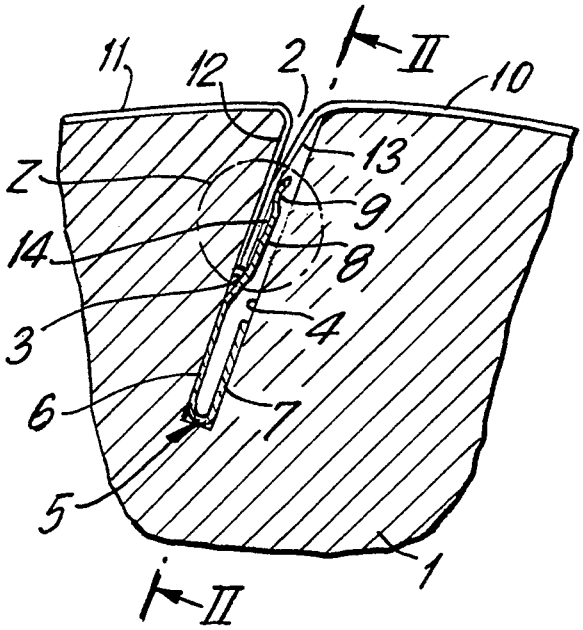
FIG. 1 is a partial view of a form cylinder in cross section.
Figure 3:
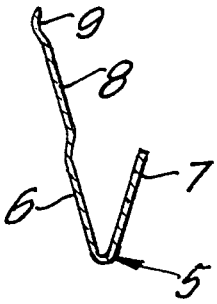
FIG. 3 is a view of a spring in cross section.

The form cylinder 1 shown in the drawings has a slot 2 having parallel lateral surfaces 3, 4 and extending in the axial direction. A plurality, e.g. three, springs 5 are inserted into the slot 2 up to the base. Each spring has two U-shaped legs 6, 7 which are pretensioned in the inserted state and contact the lateral surfaces 3, 4 of the slot 2. One leg 6 is elongated, contains a depression 8 and is rounded 9 at the end. The springs 5 are advantageously manufactured from stainless steel so as to reduce the risk of rusting into the slot 2. Further, the form cylinder 1 is advantageously provided with electroplating which is technologically conditioned so as to reach into the input region of the slot 2 and thus reduce the loss in groove width for the printing. Moreover, the electroplating which reaches into the slot 2 protects the springs 5 from slipping out by frictional engagement.

Figure 4:
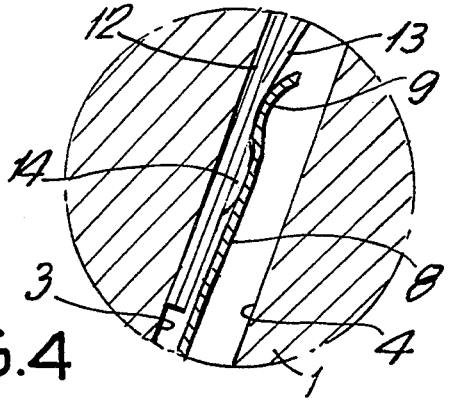
FIG. 4 is an enlarged view of detail Z from FIG. 1.
Figure 2:
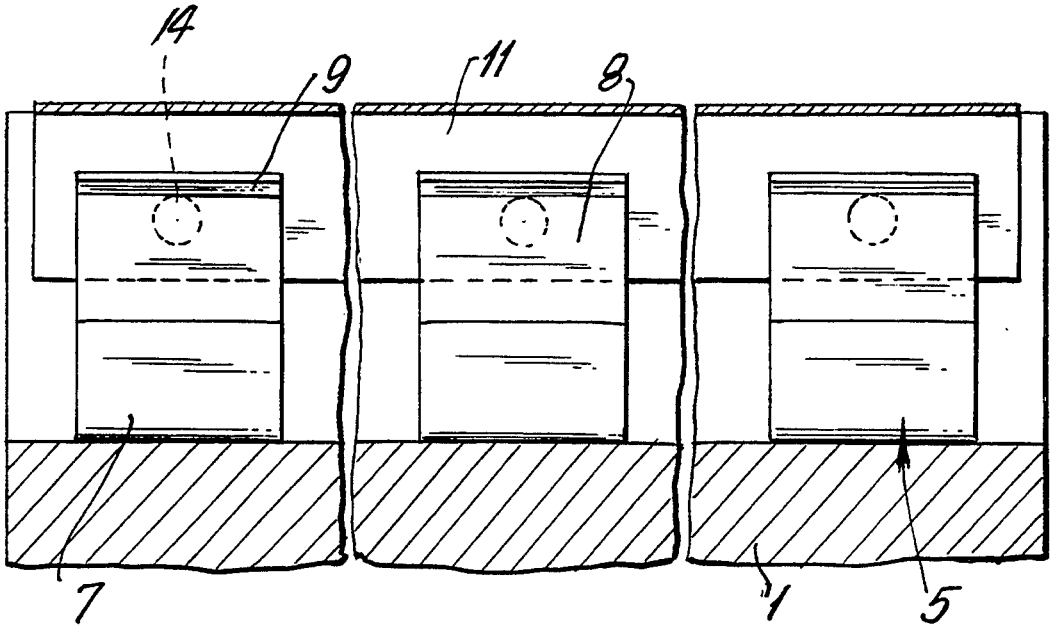
FIG. 2 is a cross sectional view along line II—II of FIG. 1.

To mount the printing plate 11, its edges 12, 13 are pressed into the slot 2 of the form cylinder 1. They come to rest between the lateral surface 3 and the elongated leg 6 of the springs 5 and are tensioned by the latter. The following edge 13 of the printing plate 11 advantageously has a plurality of preferably cup-shaped protuberances 14 which cooperate with the rounded portions 9 of the springs 5 (FIG. 4) and generate a radial tensile force component on the following edge 13 of the printing plate 11 so as to improve the plate tensioning.

In the above-described embodiment, the form cylinder has one slot for tensioning a printing plate. A plurality of slots can also be arranged so as to be uniformly distributed along the circumference of the form cylinder for tensioning a corresponding number of printing plates, which likewise lies within the scope of the present invention.

It should be understood that the preferred embodiments and examples described are for illustrative purposes only and are not to be construed as limiting the scope of the present invention which is properly delineated only in the appended claims.

What is claimed is:

1. A device for fastening a flexible printing plate on a form cylinder of a printing machine, the printing plate having a leading edge and a following edge the form cylinder including at least one slot having a base and parallel lateral surfaces and extending in the axial direction, said device comprising a plurality of leaf-shaped springs (5) insertable in the slot (2) so as to be distributed along its length, each spring (5) having two legs (6, 7) which are pretensioned when inserted into the slot and have surfaces areas in contact with surface areas of the lateral surfaces (3, 4) of the slot (2) in a U-shaped manner so that the springs are held in the slot by the pretension, one leg (6) being elongated relative to the other leg and containing a depression (8) and having a rounded (9) end portion, both the edges (12, 13) of the printing plate (11) being receivable in the depression and between the elongated leg (6) and the adjacent lateral surface (3).

2. The device according to claim 1, wherein the springs (5) are manufactured from stainless steel.

3. A fastening device for a form cylinder of a printing machine, comprising, in combination: a flexible printing plate having a following edge with a plurality of cup-shaped protuberances and a leading edge; at least one slot in the form cylinder having a base and parallel lateral surfaces and extending in an axial direction; and, a plurality of leaf-shaped springs insertable in the slot so as to be distributed along its length, each spring having two legs which are pretensioned when inserted into the slot so that the surface areas of the legs are in contact with surface areas of the lateral surfaces of the slot, one of the two legs being longer than the other and containing a depression and having a rounded end portion, both the edges of the printing plate being receivable in the depression and between the longer leg and the adjacent lateral surface of the slot.

4. A fastening device for a form cylinder of a printing machine, comprising, in combination: a flexible printing plate having a leading edge and a following edge, the form cylinder including an axially extending slot with parallel lateral surfaces; and a plurality of leaf-shaped springs insertable in the slot so as to be distributed along its length, each spring having two legs which are pretensioned when inserted into the slot so that the spring defines a U-shape and so that surface areas of each leg engage and are frictionally supported by surface areas of the lateral surfaces of the slot, a first of the two legs having a length that is longer than a length of the second of the legs, the longer first leg having a depression and a rounded end portion, both the leading edge and the following edge of the printing plate being receivable in the depression of the longer first leg so as to be between the longer first leg and the adjacent lateral surface.

5. The device according to claim 4, wherein the outer surface area of the form cylinder (1) has an electroplated portion which extends into an input region of the slot (2).

* * * * *